US009068368B2

(12) United States Patent
Rafferty et al.

(10) Patent No.: US 9,068,368 B2
(45) Date of Patent: Jun. 30, 2015

(54) ALIGNMENT DEVICE

(75) Inventors: Christopher Charles Rafferty, New South Wales (AU); Oliver Kohl, New South Wales (AU)

(73) Assignee: Blockaid Pty Ltd, New South Whales (AU)

( * ) Notice: Subject to any disclaimer, the term of this patent is extended or adjusted under 35 U.S.C. 154(b) by 0 days.

(21) Appl. No.: 13/988,433

(22) PCT Filed: Nov. 21, 2011

(86) PCT No.: PCT/AU2011/001505

§ 371 (c)(1),
(2), (4) Date: Jul. 26, 2013

(87) PCT Pub. No.: WO2012/065232

PCT Pub. Date: May 24, 2012

(65) Prior Publication Data

US 2013/0305655 A1 Nov. 21, 2013

(30) Foreign Application Priority Data

Nov. 19, 2010 (AU) ..... 2010905140

(51) Int. Cl.
*E04C 5/16* (2006.01)
*E04G 21/22* (2006.01)
*E04G 21/18* (2006.01)

(52) U.S. Cl.
CPC ..... *E04G 21/22* (2013.01); *E04G 21/185* (2013.01)

(58) Field of Classification Search
CPC ..... E04B 2/46; E04B 1/04; E04B 1/21; E04B 5/17; E04B 5/12; E04B 2/00; E04B 2/06; E04G 17/12; E04G 11/00; E04G 21/00; E04D 35/00; E04C 5/16
USPC ..... 52/742.1, 747.12, 747.13, 677, 678, 52/687, 431, 699, 686, 713, 745.21; 249/90–91, 93–94, 96
See application file for complete search history.

(56) References Cited

U.S. PATENT DOCUMENTS

| | | | | | |
|---|---|---|---|---|---|
| 1,616,977 | A | * | 2/1927 | Koivu | 52/426 |
| 4,190,999 | A | * | 3/1980 | Hampton | 52/687 |
| 4,736,554 | A | * | 4/1988 | Tyler | 52/105 |
| 4,936,062 | A | * | 6/1990 | Golston et al. | 52/127.1 |
| 5,060,436 | A | * | 10/1991 | Delgado, Jr. | 52/295 |
| 5,205,942 | A | * | 4/1993 | Fitzgerald | 249/3 |
| 5,240,224 | A | * | 8/1993 | Adams | 249/93 |
| 5,337,534 | A | * | 8/1994 | Nasca | 52/745.21 |
| 5,388,804 | A | * | 2/1995 | Cohen et al. | 249/210 |
| 5,407,182 | A | * | 4/1995 | Hartley | 269/43 |
| 5,670,076 | A | * | 9/1997 | Leek | 249/53 M |
| 5,688,428 | A | * | 11/1997 | Maguire | 249/91 |

(Continued)

FOREIGN PATENT DOCUMENTS

| | | |
|---|---|---|
| CA | 1121613 | 4/1982 |
| WO | 2009012519 | 1/2009 |

*Primary Examiner* — Beth Stephan
(74) *Attorney, Agent, or Firm* — Tarolli, Sundheim, Covell & Tummino LLP

(57) ABSTRACT

The invention resides in an alignment device able to align substantially vertical starter bars for a masonry block wall, the alignment device comprising a plurality of spacer arms spaced a predetermined distance from each other and a plurality of attachment members attached to respective spacer arms, the attachment members able to be operatively attached to the vertical starter bars.

19 Claims, 4 Drawing Sheets

(56) References Cited

U.S. PATENT DOCUMENTS

| | | | | |
|---|---|---|---|---|
| 5,813,188 | A * | 9/1998 | Behlen | 52/699 |
| 6,141,937 | A * | 11/2000 | Dressler | 52/742.1 |
| 6,571,526 | B2 * | 6/2003 | Queen | 52/677 |
| 6,591,574 | B2 * | 7/2003 | Humphrey | 52/678 |
| 6,898,915 | B2 * | 5/2005 | Hancock | 52/677 |
| 7,290,749 | B1 * | 11/2007 | Jessop et al. | 249/34 |
| 7,445,192 | B2 * | 11/2008 | Gridley et al. | 249/207 |
| 7,467,777 | B2 * | 12/2008 | Huber et al. | 249/214 |
| 2002/0112437 | A1 | 8/2002 | Queen | |
| 2003/0101670 | A1 * | 6/2003 | Gustin | 52/293.1 |
| 2005/0023432 | A1 * | 2/2005 | Huber et al. | 249/34 |
| 2007/0186504 | A1 * | 8/2007 | Gavin | 52/677 |
| 2008/0265128 | A1 * | 10/2008 | Hughes | 249/190 |
| 2009/0000137 | A1 * | 1/2009 | Diaz | 33/562 |
| 2010/0107546 | A1 * | 5/2010 | Diaz | 52/699 |
| 2011/0308183 | A1 * | 12/2011 | Asada et al. | 52/414 |

* cited by examiner

ALIGNMENT DEVICE

FIELD OF THE INVENTION

This invention relates town alignment device. In particular, the invention relates to an alignment device for starter bars for masonry block walls.

BACKGROUND TO THE INVENTION

The use of masonry block walls in construction is very popular. In order to construct a masonry block wall that has the necessary structural strength, the masonry block wall must be tied to an associated foundation or footing. When the foundation or footing for a masonry block wall is being prepared, reinforcing bars are placed in the footing. These reinforcement bars (known as starter bars) protrude from the concrete footing and are required to engage the masonry block wall. However, the starter bars are often not placed in the correct location in relation to the cavity in the masonry blocks of the masonry block wall.

Misaligned starter bars are a huge problem for a block layer. The block layer is often unable to bend or adjust the incorrectly placed starter bars coming out from the concrete footing. Accordingly, the starter bars are not in their correct position and do not line up with the vertical reinforcing bars that are placed in the masonry block wall. The starter bars being out of position and not aligning with the vertical reinforcing bars in the masonry block wall during wall construction will result in the wall not meeting the structural capacity as detailed in the engineering specification for the wall. In a worst case scenario, the entire wall, including the footing, will need to be demolished and rebuilt at substantial cost.

The majority of reinforced masonry block walls require starter bars (and vertical reinforcing bars) to be generally used at 400 mm intervals along the wall. The problem of misaligned starter bars is therefore a considerable inconvenience to the block layer because of the large number of starter bars in each wall construction.

OBJECT OF THE INVENTION

It is an object of the invention to overcome or at least alleviate one or more of the above disadvantages and/or provide the consumer with a useful or commercial choice.

SUMMARY OF THE INVENTION

In one form, although not necessarily the only or broadest form, the invention resides in an alignment device able to align substantially vertical starter bars for a masonry block wall, the alignment device comprising:

a plurality of spacer arms spaced a predetermined distance from each other; and a plurality of attachment members attached to respective spacer arms, the attachment members able to be operatively attached to the vertical starter bars.

Preferably there are at least three or more spacer arms. The spacer arms are normally equally spaced from each other.

The spacer arms may be interconnected by at least one connector rail. Typically, there are two connector rails.

The spacer arms may be removably attached to the at least one connector rail. Alternatively, the spacer arms may be integrally formed with the connector rail.

Typically, the spacer arms are relatively linear. However, it should be appreciated that the spacer arms may be non-linear.

Similarly, the at least one connector rail is relatively linear. However, it should be appreciated that the at least one connector rail could be non-linear.

The attachment members are preferably in the form of a clip. However, other forms of attachment members may be suitable, such as clasp, buckle, catch, clamp, clench, clinch, fastening, grapple, hook, pin or a snap.

The attachment members may be removably attached or fixed to respective spacer arms.

One or more supports may form part of the alignment device to ensure that the spacer arms are held at a desired position. Typically, there are a plurality of supports. More preferable there are at least three supports. The supports may be connected or tied to a spacer arm and/or a connector rail.

Each support may include a holder and at least one leg. The holder may operatively support the spacer arms. The holder may engage and/or position and/or align a spacer arm and/or a connecting rail. The holder may include holder members to engage and/or align a spacer arm or a connecting rail.

The leg may be removably attached to the holder. The leg may be movable and/or adjustable with respect to the holder. However, it should be appreciated that the leg and holder may be fixed with respect to each other. Accordingly, the leg and holder may be integrally formed.

In another form, the invention resides in a method of aligning substantially vertical starter bars for a masonry block wall; the method including the steps of:

locating a plurality of starter bars at a desired position, each starter bar having at least one attachment member; and attaching the vertical starter bars to at least some of the attachment members to align the vertical starter bars.

The method may further include one or more of the steps of:

connecting the starter bars to a at least one connection rail;

operatively supporting the starter bars with a support.

BRIEF DESCRIPTION OF THE DRAWINGS

An embodiment, by way of example only, will be described with reference to the accompanying drawings, wherein.

DETAILED DESCRIPTION OF THE PREFERRED EMBODIMENT

Figure 1:
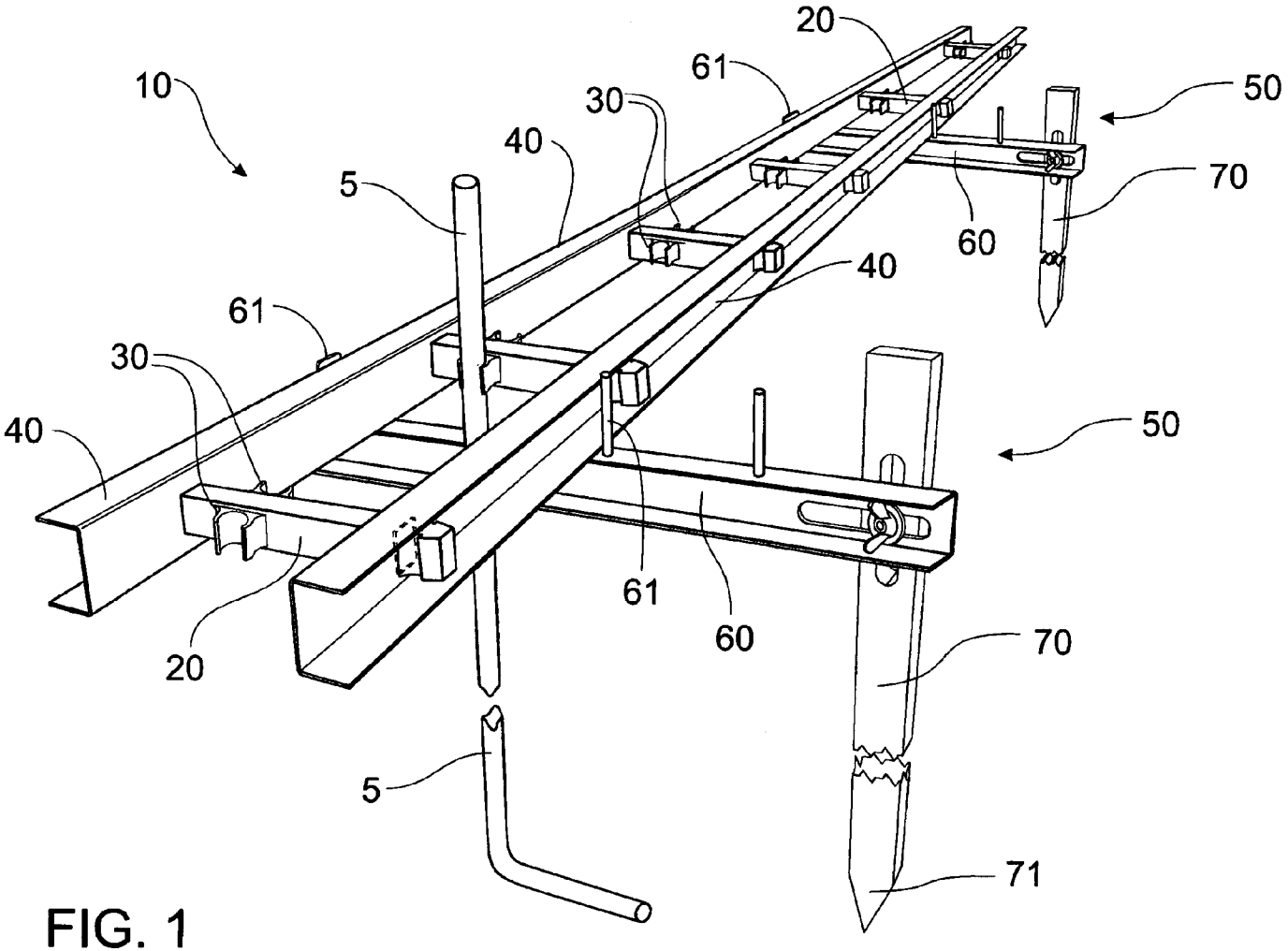
FIG. 1 is a perspective view of an alignment device being used to support a series of starter bars according to an embodiment of the invention.
Figure 2:
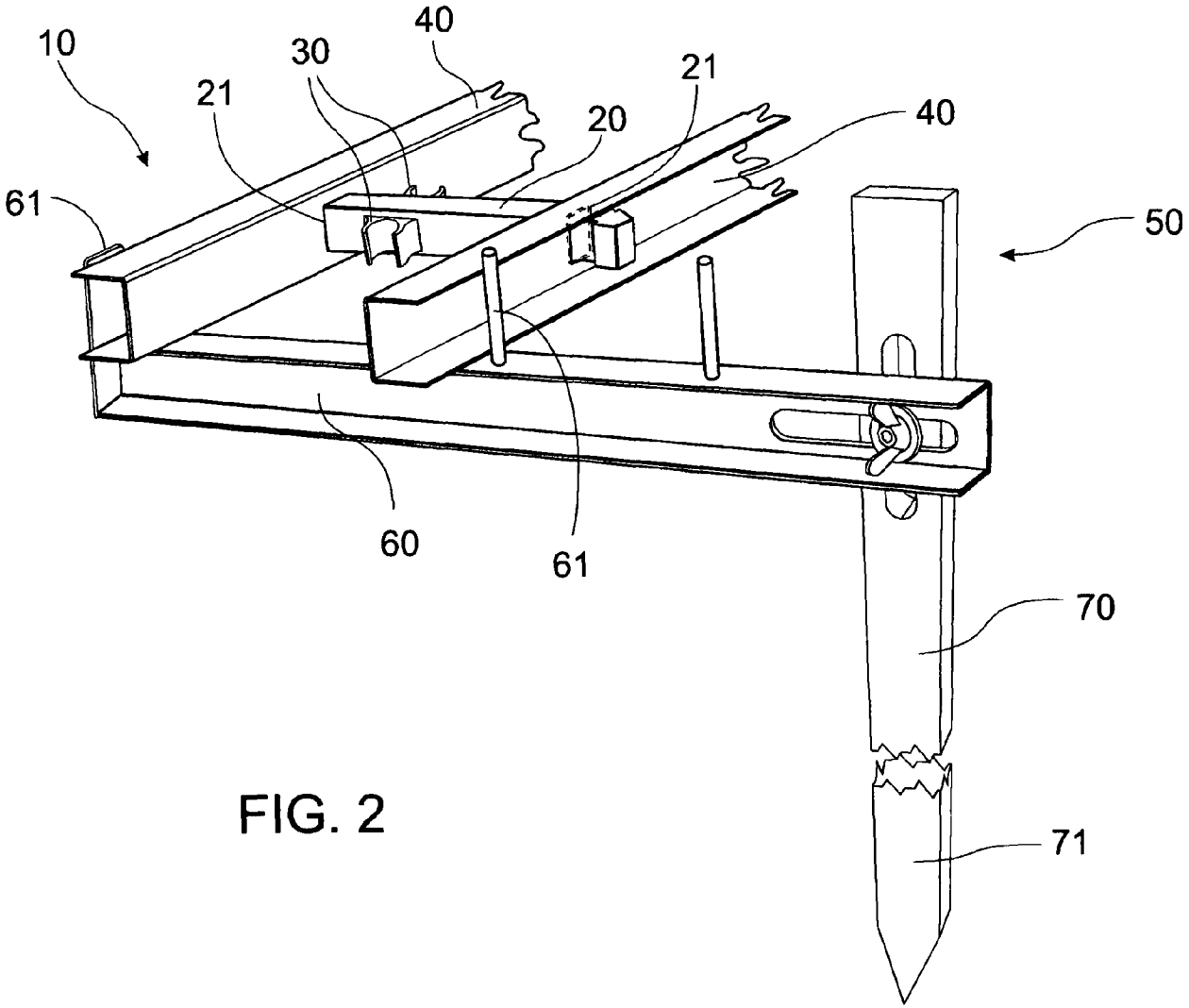
FIG. 2 is a side sectional view of an alignment device according to an embodiment of the invention.

FIGS. 1 and 2 show an alignment device 10 that is used to hold a series of starter bars 5 in a desired position in order to ensure the starter bars 5 are positioned correctly within a proposed masonry wall. The alignment device 10 includes a series of spacer arms 20, an associated series of attachment members 30, two connection rails 40 and a number of supports 50.

Figure 3:
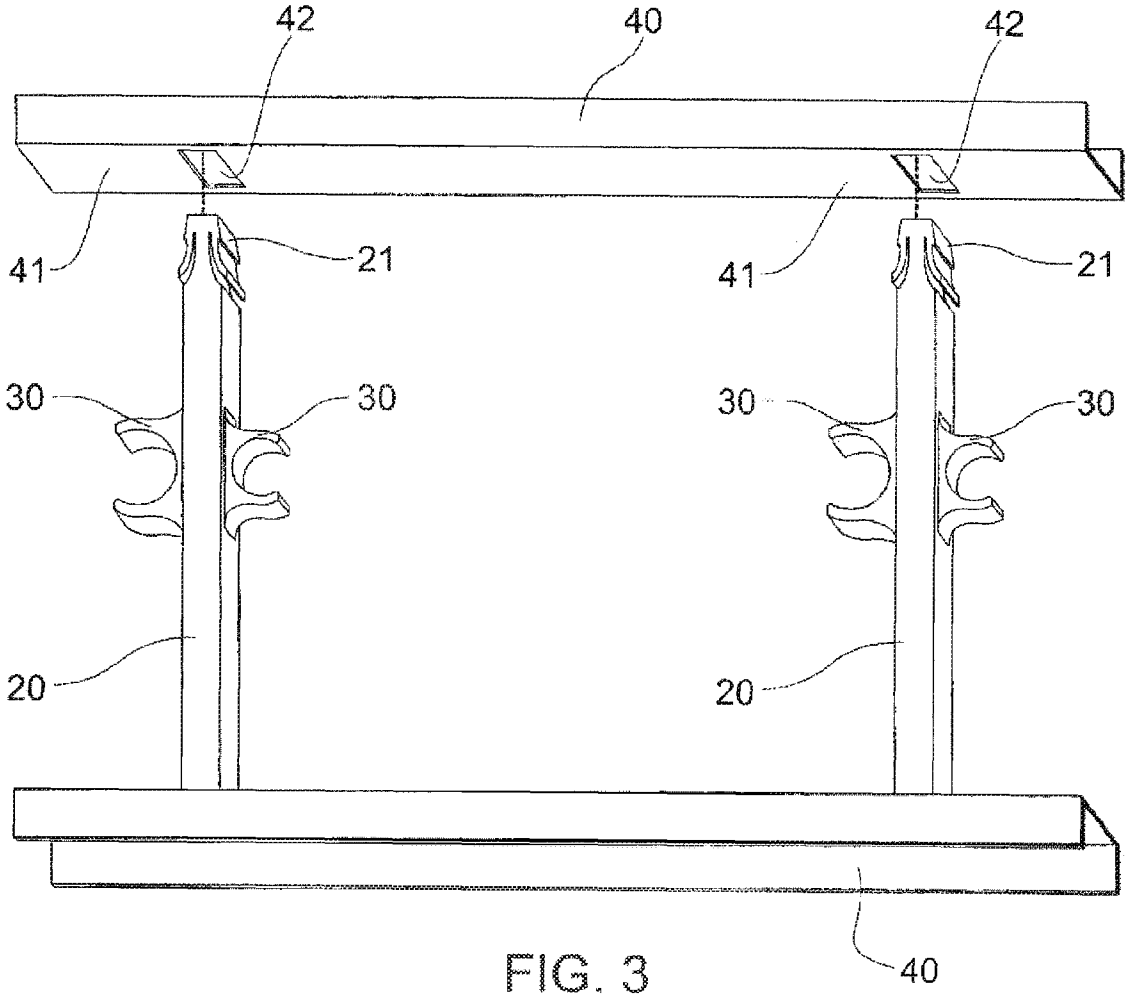
FIG. 3 is a perspective view of an alignment device as shown in FIG. 1 according to an embodiment of the invention.

The spacer arms 20 are used to space starter bars 5 at the correct distance from each other. The spacer arms 20, shown in more detail in FIG. 3, are made from injection moulded plastic. However, it should be appreciated that the spacer arms 20 may be made using other suitable materials. The spacer arms 20 are elongate and rectangular in transverse cross section. However, it should be appreciated that the spacer arms 20 may be of a variety of other transverse cross sections including round, elliptical, square or the like shape. A snap-in clasp 21 is located at each of the ends of each of the spacer arms 20 to connect the spacer arms 20 to respective connection rails 40. The spacer arms 20 may be made of various lengths to suit masonry walls of different sizes.

Figure 4:
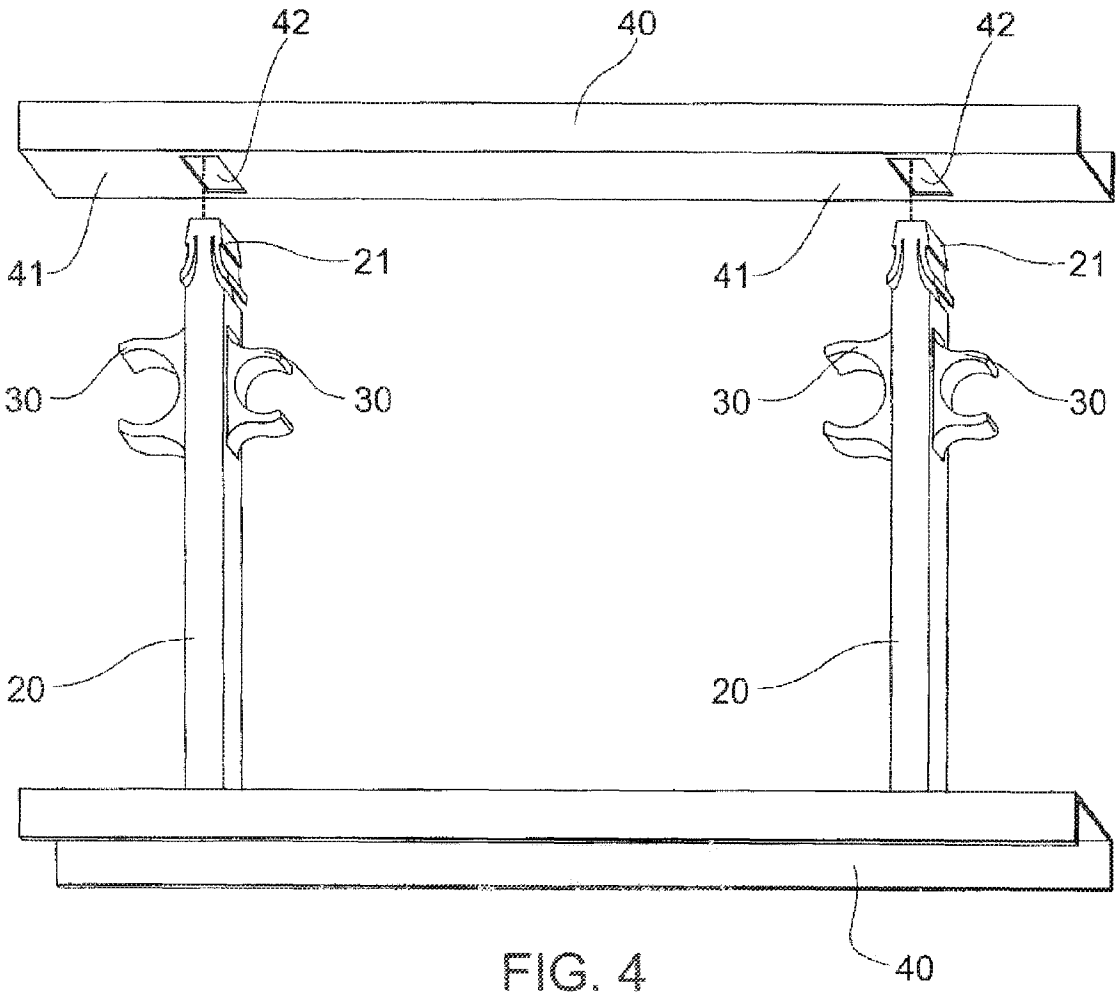
FIG. 4 is a perspective view of an alignment device incorporating a different spacer arm.

The attachment members 30 are used to hold respective starter bars 5. The attachment members 30 are removably attached to the spacer arms 20. A person skilled in the art would appreciate that various known forms of removable attachment of the attachment members to the spacer arms may be used. For example, the attachment members may be threaded with a corresponding threaded hole provided in the spacer arm. Alternatively, the attachment members may be snap locked into corresponding holes provided in the spacer arm 20. This enables attachment members 30 of different sizes to be attached to the spacer arms 20 as shown in FIG. 3 and FIG. 4. However, it should be appreciated that the attachment members 30 may be integrally formed with the spacer arms 20.

The position of the attachment members 30 may be varied according with structural requirements of a masonry wall. For example, the attachment members 30 shown in FIG. 3 are located centrally on the spacer arms 20 whilst the attachment members 30, shown in FIG. 4, is located toward one end of the spacer arm 20. It should be appreciated that the number of attachment members 30 and the position of the attachment members 30 may be varied on the spacer arms 20 depending on requirements. For example, a spacer arm 20 may have two attachment members 30, one attachment member 30 having a position as shown in FIG. 3 and one attachment member 30 as shown in FIG. 4.

The attachment members 30, shown in FIGS. 3 and 4, are in the form of C-shaped clips. The clips are resilient so that a starter bar 5 can be held by the clip. The C-shaped clips may be of different sizes to cater for different sized starter bars 5. It should be appreciated that other forms of attachment members 30 may be used instead of the C-shaped clips to hold the starter bars 5.

The connection rails 40 are used to hold the spacer arms 20. The connection rails 40 are in the form of a C-section 41. Holes 42 are located through and spaced equally along the length of the C-section 41. The holes 42 are used for location of respective snap-in clasps 21 of the spacer arms 20. As an alternative, it should be appreciated that the spacer arms 20 and the connection rails 40 may be permanently fastened to each other. Both the connection rails 40 are of a continuous length. However, it should be appreciated that the connection rails 40 may be formed from sections which are fitted together to form the connection rail 40. A person skilled in the art would readily appreciate how sections are connected together. Further, it should be appreciated that the connection rails may be shaped differently.

The supports 50, shown in detail in FIG. 2, are used to support the connection rails 40 and accordingly the spacer arms 20. Each support 50 is formed from a holder 60 and a leg 70. The holder 60 includes two holding members 61 which engage and support the connection rails 40. The holder members 61 are adjustable to align the spacer arms 20 and connection rails 40 above a trench to represent the location of the wall to be built. It should be appreciated that the holder 60 may be modified to engage and support the spacer arms 20.

The leg 70 is located at one end of the holder 60 and has a pointed end 71 for digging into the ground. The leg 70 is movable with respect to the holder 60.

In order to correctly align a series of starter bars 5, the first step is to locate each pointed end 71 of the leg 70 of the supports 50 within the ground and away from and adjacent to (but not within) a trench for forming a concrete footing. The holders 60 of the supports 50 are then moved with respect to the leg 70 to locate the holders 60 at a desired height and desired horizontal location representing the exact position of the block wall to be built. Next, the attachment members 30 are selected depending on the diameter of the starter bars 5. The spacer arms 20 are also selected depending on requirements of the masonry wall such as positioning requirements of the starter bar 5 and the size of the blocks.

The attachment members 30 and the spacer arms 20 are joined together (if required). Subsequently, the spacer arms 20 are inserted into the holes of the connection rails 40 to form a "ladder" arrangement. The spacer arms 20 are held to the connection rails 40 using the snap-in clasps 21.

Once the starter arms 20 and connection rails 40 are joined together, the connection rails 40 are placed within holders 60 of the supports 50. The starter bars 5 are then attached to the attachment members 30 to hold the starter bars 5 in their desired location. When the starter bars 5 are set plumb, a base of the starter bar 5 can be tied off to a reinforcing cage in the footing. Accordingly, the footing can then be laid ensuring the starter bars 5 are in the correct location with respect to the masonry wall to be built.

There are considerable advantages in using the alignment device 10 to install the starter bars 5 in a precise location when forming the footing, when pouring the concrete for the footing and when building the masonry block wall on the top of the footing. The advantages include:

1. Reducing the time taken to set out and accurately tie the starter bars 5 to the reinforcing cage in the footing trench and maintaining the starter bars 5 in vertical alignment.

2. Allowing one person to easily tie the starter bars 5 in the correct location in the footing trench and thereby ensuring the starter bars 5 will be in the correct location in the masonry blocks when the blocks are laid.

3. Providing the correct location for the starter bars 5 for both centrally located and non-centrally located reinforcing steel applications, being typical specifications for reinforced masonry block walls.

4. Ensuring the starter bars 5 are rigidly and securely positioned by the combination of tying the starter bar 5 to the reinforcing cage in the trench and clipping the starter bar 5 to the alignment device 10 at about 500 mm above ground level. This two point connection provides the additional security that ensures the starter bar 5 does not move out of place even during the pouring of the concrete for the footing.

5. Providing a simple and effective means of setting and maintaining the starter bars 5 in a vertical position to ensure they line up adjacent to the vertically placed reinforcing steel in the masonry block wall.

6. Providing the longitudinal set out of the starter bars 5 at 400 mm centres for the length of the wall or at the centres specified in the engineering specification.

7. Assisting in the containment of the entire reinforcing steel grid of the foundation.

In this specification, the terms "comprise", "comprises", comprising" or similar terms are intended to mean a non-exclusive inclusion, such that a system, method or apparatus that comprises a list of elements does not include those elements solely, but may well include other elements not listed.

It should be appreciated that various other changes and modifications may be made to the invention described without departing from the spirit or scope of the invention. For example, the alignment device could be manufactured in one piece flat lengths of extruded plastic with the connection rails and spacers arms being integrally formed. The lengths have sufficient strength to adequately support the starter bars above ground level while being flexible enough to be rolled up for convenience between jobs. Accordingly, the starter bars in this instance will be tied to spacer arms using wire as the attachment members.

The invention claimed is:

1. An alignment device able to align substantially vertical starter bars for a masonry block wall, the alignment device comprising:

a plurality of spacer arms spaced a predetermined distance from each other;

a plurality of attachment members respectively attached to the plurality of spacer arms, the attachment members able to be operatively attached to the vertical starter bars: and at least one adjustable support to operatively support that the spacer arms are at a desired position, wherein the plurality of attachment members are configured to receive a vertical portion of the starter bars therethrough; and wherein the at least one adjustable support includes a holder and a leg such that when the leg and the holder engage one another the leg is configured to adjust vertically along the holder.

2. The alignment device of claim 1 wherein there are at least three spacer arms.

3. The alignment device of claim 1 wherein the spacer arms are equally spaced from each other.

4. The alignment device of claim 1 wherein the spacer arms are interconnected by at least one connector rail.

5. The alignment device of claim 4 wherein there are two connector rails.

6. The alignment device of claim 4 wherein the spacer arms are removably attached to the at least one connector rail.

7. The alignment device of claim 4 wherein the spacer arms are integrally formed with the at least one connector rail.

8. The alignment device of claim 1 wherein the spacer arms are linear.

9. The alignment device of claim 4 wherein the least one connector rail is linear.

10. The alignment device of claim 1 wherein the attachment members are in the form of a clip.

11. The alignment device of claim 1 wherein the leg is slidably connected to the holder.

12. The alignment device of claim 1 wherein the leg is configured to adjust horizontally along the holder.

13. The alignment device of claim 1 wherein the holder engages with the spacer arm or a connecting rail.

14. The alignment device of claim 1 wherein the leg is movable and/or adjustable with respect to the holder.

15. A method of aligning substantially vertical starter bars for a masonry block wall; the method including the steps of:

locating a plurality of vertical starter bars at desired positions, each starter bar having at least one attachment member;

attaching a vertical portion of each of the vertical starter bars to at least one of the attachment members to align the vertical starter bars; and operatively supporting the attachment member at a desired location with a support, the support including a leg and a holder such that when the leg and the holder engage one another the leg is configured to adjust vertically along the holder.

16. The method of claim 15 including the step of connecting the starter bars to at least one connection rail.

17. The method of claim 16, wherein the leg is located in the ground and spaced apart from the connection rail.

18. The method of claim 15 wherein the leg is configured to adjust horizontally along the holder.

19. The method of claim 15 wherein the leg slides along the holder.

* * * * *